US010781610B2

(12) United States Patent
Murphy

(10) Patent No.: US 10,781,610 B2
(45) Date of Patent: Sep. 22, 2020

(54) REMOTE CONTROL UNLOCKING AND LOCKING SYSTEM

(71) Applicant: Matthew Murphy, Wellesley, MA (US)

(72) Inventor: Matthew Murphy, Wellesley, MA (US)

( * ) Notice: Subject to any disclaimer, the term of this patent is extended or adjusted under 35 U.S.C. 154(b) by 0 days.

(21) Appl. No.: 16/435,643

(22) Filed: Jun. 10, 2019

(65) Prior Publication Data

US 2019/0352932 A1 Nov. 21, 2019

Related U.S. Application Data

(63) Continuation-in-part of application No. 14/327,946, filed on Jul. 10, 2014, now Pat. No. 10,319,163.

(60) Provisional application No. 61/844,539, filed on Jul. 10, 2013, provisional application No. 61/862,192, filed on Aug. 5, 2013.

(51) Int. Cl.
*E05B 47/00* (2006.01)
*E05B 1/00* (2006.01)

(52) U.S. Cl.
CPC ..... *E05B 47/0012* (2013.01); *E05B 1/0007* (2013.01); *E05B 2047/0091* (2013.01); *E05Y 2900/132* (2013.01)

(58) Field of Classification Search
CPC ..... G07C 2009/00746; G07C 9/00126; G07C 9/00174; G07C 2009/00753; G07C 9/00182; G07C 9/00007; G07C 9/00309; E05B 59/00; E05B 63/0004
See application file for complete search history.

(56) References Cited

U.S. PATENT DOCUMENTS 6,411,195 B1 * 6/2002 Goldman ..... G07C 9/00182 340/407.1
6,556,124 B1 * 4/2003 Laroche ..... B60R 25/20 307/10.2
2007/0229257 A1 * 10/2007 Bliding ..... E05B 49/00 340/566
2008/0086842 A1 * 4/2008 Dayton ..... E05B 1/0053 16/412
2008/0136678 A1 * 6/2008 Harrington ..... G06F 3/043 341/20
2012/0260700 A1 * 10/2012 Matre ..... E05B 85/14 70/91
2014/0285320 A1 * 9/2014 Blackmer ..... B60R 25/23 340/5.72
2015/0102609 A1 * 4/2015 Johnson ..... E05B 1/0007 292/144
2015/0123762 A1 * 5/2015 Park ..... G07C 9/00182 340/5.51

* cited by examiner

*Primary Examiner* — Mirza F Alam
(74) *Attorney, Agent, or Firm* — Bay State IP, LLC

(57) ABSTRACT

A portable, temporary removable system for locking and unlocking a door knob, door lever or locking deadbolt without the requirement of using keyed entry. Several manners of automated locking and unlocking are introduced and the instant system is designed for quick installation and removal. Once attached, the system may be remotely controlled from the outside of the door via a pattern of knocks, via electronic communications or a combination of a knock pattern and electronic communication.

5 Claims, 16 Drawing Sheets

REMOTE CONTROL UNLOCKING AND LOCKING SYSTEM

CROSS REFERENCE TO RELATED APPLICATION

This application is a continuation-in-part and claims the benefit of and takes priority from U.S. patent application Ser. No. 14/327,946 filed on Jul. 10, 2014, which in turn claims the benefit of and takes priority from U.S. Provisional Application No. 61/844,539 filed on Jul. 10, 2013 and U.S. Provisional Application No. 61/862,192 filed on Aug. 5, 2013, the contents of which are hereby incorporated by reference.

BACKGROUND OF THE INVENTION

Field of the Invention

The present invention relates to a keyless and remote access controlled locking and unlocking system.

Description of the Related Art

Keyed entry door knobs and door levers are commonly used to restrict access to homes, businesses and other structures. These door knobs and door levers contain an internal lock mechanism which includes a keyed lock, accessible on the exterior of the door and a finger-operated rotational lock/unlock mechanism, accessible on the interior of the door. The interior finger-operated rotational lock/unlock mechanism is designed to be actuated by human fingers and is designed such that users do not need a key to lock or unlock the door knob or door lever from the interior of the door.

When operating a door knob or door lever from the exterior, a key is required to be inserted into the exterior lock mechanism and rotated in order to gain access to the locked area. Keys are costly to reproduce and the method of duplicating keys is often inaccurate and imprecise, resulting in keys that do not properly open the lock. Keys can be easily lost reducing the security of the device. In addition, keyed locking door knobs, door levers, and deadbolt locks allow for only one key pattern per door knob or door lever so it is not possible to offer different types of access control to different users.

Electronic and mechanical doorknobs containing a numerical or alphanumeric keypad currently exist which allow users to enter a password or numerical code in order to unlock the door knob locking mechanism. Additionally, systems exist which allow a door knob or door level to be controlled remotely via wireless communications and via the internet. These current designs are required to be permanently installed in the door and may be visible from the outside of the door.

Key lockboxes are currently in use which allow users to lock a key in a protective box in close proximity to the keyed entry doorknob. Most key lockboxes are accessed by entering a numeric or alphanumeric combination on the outside of the box structure. Some electronic lockboxes open via communication with smartphones or other electronic devices. These key lockboxes allow multiple users possessing the lockbox combination or electronic access privileges to gain access to the key inside the box. The user then takes possession of the key in order to insert it into the exterior of the door knob, door lever, or deadbolt locking mechanism in order to unlock the lock mechanism. This approach allows several users to share a single key within the lockbox but it is a cumbersome and time consuming process. In addition, security is reduced because every user with lockbox access takes possession of the physical key for a period of time.

Thus, it is possible for users to duplicate the key during the time they possess it. Once a user takes possession of a key, it is impossible to be certain that access has been revoked unless the key pattern of the lock is physically changed or the entire door knob or door lever is replaced. In addition, users may forget to return the key to the lockbox.

What is needed is a device which can be temporarily attached to the door knob, door lever or deadbolt lever on the inside of the door in order to actuate the rotational lock/unlock mechanism and which can be remotely operated from the outside of the door without the use of a key.

SUMMARY OF THE INVENTION

The instant invention, as illustrated herein, is clearly not anticipated, rendered obvious, or even present in any of the prior art mechanisms, either alone or in any combination thereof.

Therefore, it is an object of the instant invention to allow a standard locking door knob, door lever or deadbolt to have a system temporarily attached to it to allow for remote locking/unlocking without a key and from the outside of the locked door. This will lead to savings in time and money, more flexible access control and greater security by removing the limitations and vulnerabilities of physical keys. The temporary and tool free installation and removal adds to peace of mind of the user. Easily removing the device from the door knob, door lever, or deadbolt lever eliminates the possibility that the door lock may be accessed remotely or electronically when not installed. For example, a home owner can temporarily install the instant invention to their door to allow for package delivery to the interior of their home when they are at work but may not want the same kind of access to be possible while they are home asleep.

It is a further object of the instant invention to provide a temporary keyless lock/unlocking system which is not visible from the outside of the locked door.

It is a further object of the instant invention to provide the user a way to interact with the system either through electronic wireless data communications such as via a networked smartphone or other wireless communications device or the user may interact with the system by using their hand to knock a pattern of knocks on the outside of the door which are interpreted and compared with a knock pattern stored within the memory of the system in order to validate the knock pattern or the system may access an external application to validate the knock pattern. A combination of knock pattern recognition and wireless communication may also be used to provide two layers of security and flexibility.

It is a further object of the instant invention to provide a temporary keyless lock/unlocking system which fits over the door handle, door lever, door knob or deadbolt lever of a door while still allowing human fingers to access to the handle and internal components of the temporary keyless lock/unlocking system, such as the deadbolt lever engagement assembly.

It is a further object of the instant invention to provide a temporary keyless lock/unlocking system which is compact and does not hinder standard use of a door knob from the interior of a home, business, or other structure.

In this respect, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
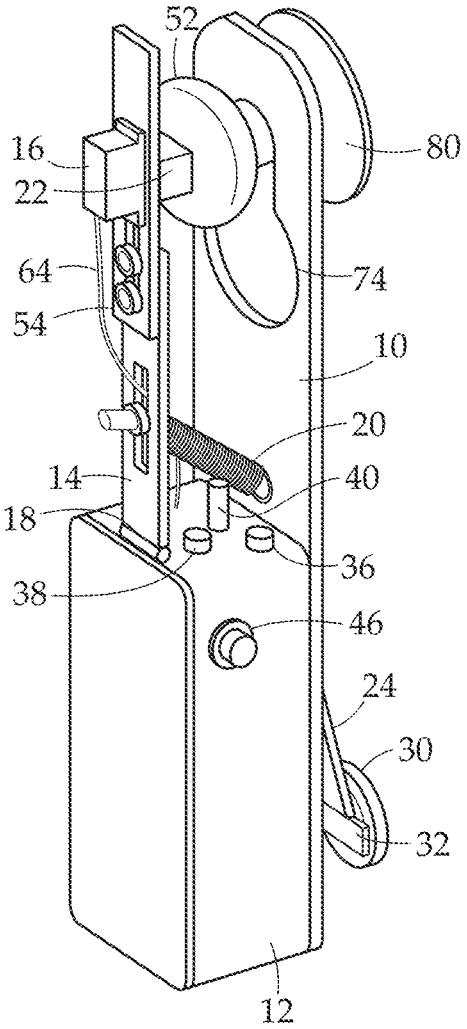
FIG. 1 is a right side view of the invention mounted to a standard doorknob.

The detailed description set forth below is intended as a description of presently preferred embodiments of the invention and does not represent the only forms in which the present invention may be construed and/or utilized. The description sets forth the functions and the sequence of the steps for producing the system and accompanying apparatus. However, it is to be understood that the same or equivalent functions and sequences may be accomplished by different embodiments also intended to be encompassed within the scope of the invention.

FIGS. 1-5 and 9 depict various viewpoints of the present invention and the electronics container 12. The present invention includes a frame 10 which allows the device to be easily and quickly attached to a standard door knob 52 or door lever. It includes an electronics container 12 for housing the electronic components such as internal memory 68, batteries 70, micro controller 66, network interface device 72, lights, audio devices and switches necessary for the device to interpret input from the user and to present audio and visual feedback to the user. Software stored within the micro controller 66 determines the behavior of the system. The electronics container 12 includes a power switch 46, a rotational direction switch 48, a knock validation mode switch 42, and an audio mode switch 44. The top surface of the electronics container 12, contains a programming switch 50, a programming indicator light 34, a status indicator light 36 and a network connectivity indicator light 38 to indicate when the device is connected to LAN or WAN networks via WiFi or cellular connection. A knock sensitivity adjustment knob 40 is mounted within the top surface of the electronics container 12.

A servo tension arm 14 is mounted to the top surface of the electronics container 12 via a servo tension arm hinge 18. A servo tension arm spring 26 is connected between the servo tension arm 14 and the frame 10 in order to provide pressure between the servo tension arm 14 and the door knob 52 when the frame 10 is mounted on the door knob 52. The servo tension arm 14 is made from two sections of rigid material attached to each other by way of bolts mounted within a servo tension arm length adjustment slot 54. This servo tension arm length adjustment slot 54 allows the relative position of the two sections to be changed causing the length of the servo tension arm 14 to be adjusted to compensate for different types and sizes of door knobs 52 and allow the end of the servo tension arm 14 to maintain proper alignment to the door knob 52. The end of the servo tension arm 14 contains a slot to mount a servo motor 16 so that the rotational axis of the servo motor 16 aligns with the rotational axis of the finger-operated rotational lock/unlock mechanism 56 within the door knob 52. A lock mechanism mating coupler 22 is mounted to the rotational axis of the servo motor 16. The servo mating coupler 22 is shaped to fit the contour of the finger-operated rotational lock/unlock mechanism 56 within the door knob 52 and transfer the rotational force of the servo motor 16 to the finger operated rotational lock/unlock mechanism 56. The servo motor 16 is connected electronically to a micro controller 66 within the electronics container 12 via servo motor wires 64. Software within the micro controller 66 controls the behavior of the servo motor 16 as well as all other electronic components of the system.

A piezo tension arm 24 is mounted to the back side of the frame 10 via a piezo tension arm hinge 28. A piezo tension arm spring 26 is mounted between the frame 10 and the piezo tension arm 24 so that the piezo tension arm 24 is kept tensioned against the door 60. A piezo knock detector 30 is mounted to the end of the piezo tension arm 24 via a piezo tension arm hinge 28. The piezo tension arm hinge 28 allows the piezo knock detector 30 to pivot and ensures that the maximum surface area of the piezo knock detector 30 remains in contact with the door 60. The piezo knock detector 30 converts the vibrations resulting from knocking on the door 60 into electrical current which is transferred via piezo knock detector wires 62 to be analyzed by the micro controller 66 within the electronics container 12.

A user attaches the system to a door knob 52 by pulling forward on the servo tension arm 14 and maneuvering the wide portion of the frame's 10 slotted door knob mounting hole 74 so that the door knob protrudes through the wide portion of the slotted door knob mounting hole 74. Once the door knob is protruding through the slotted door knob mounting hole 74 in the frame 10, the frame 10 is maneuvered downward so that the frame 10 comes to rest with the door knob stem 80 seated in the narrow slot of the slotted door knob mounting hole 74. The servo tension arm is then allowed to spring forward so that the servo mating coupler 22 comes to rest in direct contact with the finger operated rotational lock/unlock mechanism 56 of the door knob 52.

In order to use the system, a user selects the desired knock sensitivity threshold by turning the knock sensitivity adjustment knob 40. The user then switches on the power switch 46. Users interact with the system by knocking a pattern of knocks on the outside of the door 60 using their hand 76 or any other knocking device which will generate a vibration on the door 60. The goal of the knock sensitivity adjustment knob 40 is to filter out background vibrations to prevent the system from interpreting background vibrations as knocks. Vibrations above the desired threshold will be interpreted as knocks. Vibrations below the desired threshold will be ignored.

Figure 2:
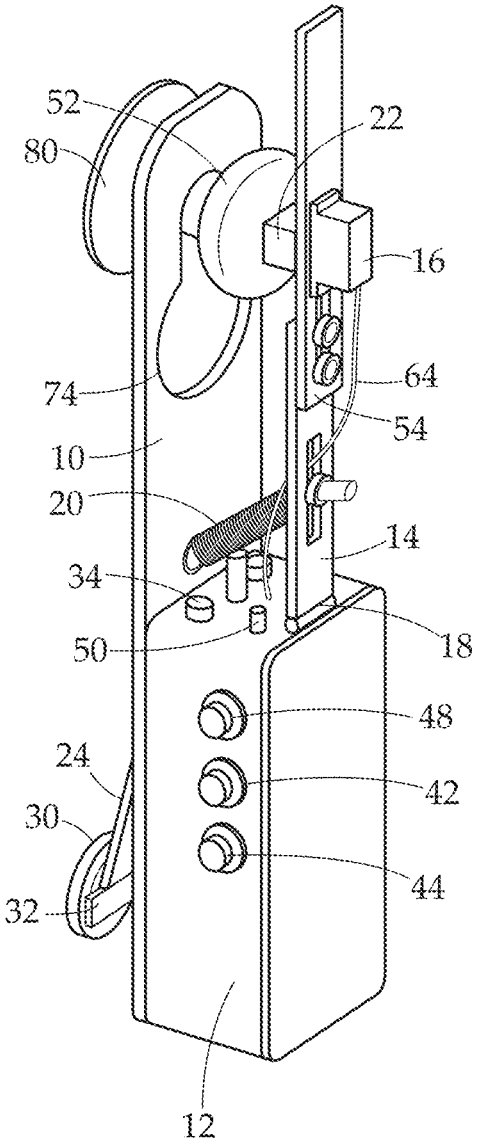
FIG. 2 is a left side view of the invention mounted to a standard doorknob.
Figure 5:
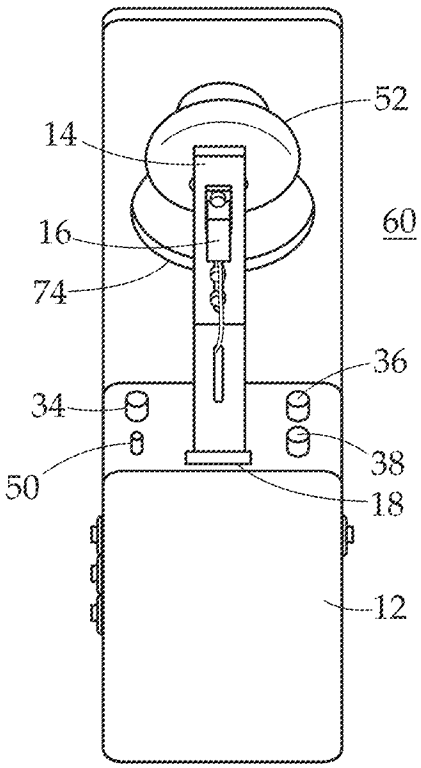
FIG. 5 is a top view of the invention.
Figure 3:
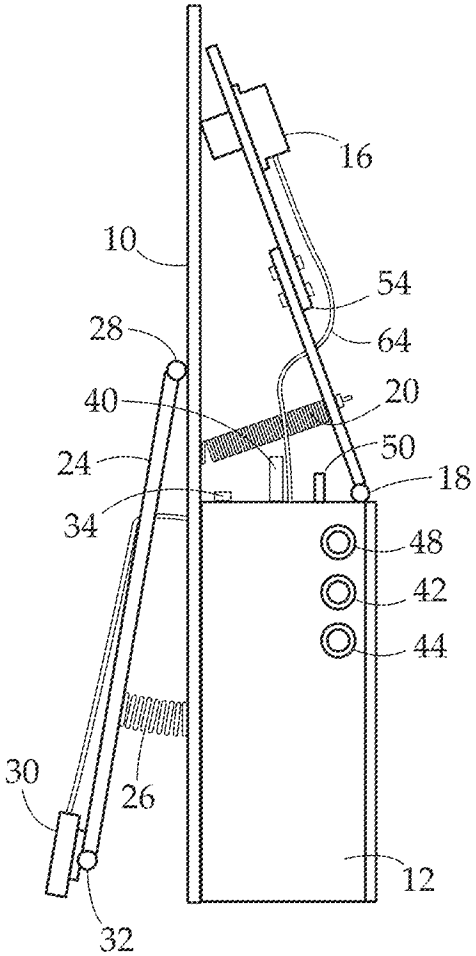
FIG. 3 is a left side view of the invention.

FIGS. 2 and 3 depict side views of the system wherein a user may select two modes on the knock validation mode switch 42. The two modes are "memory" or "external". In "memory" mode, the micro controller 66 within the system will compare a user's submitted knock pattern with a knock pattern stored within the system's internal memory 68. If the knock pattern input by the user matches the pattern stored within internal memory 68, the knock pattern is considered valid and the servo motor 16 will turn the servo mating coupler 22 which will turn the finger operated rotational lock/unlock mechanism 56 and the door knob 52 will be unlocked and access will be granted to the user. If the knock validation mode switch 42 is set to "external", prior to the validation of the user's knock pattern against the knock pattern stored within internal memory 68, the system will initiate an HTTP request to an external application 78 to determine if access has been authorized via the external application 78. Software contained within the micro controller 66 will interpret the HTTP response from the external application 78 to determine if access has been authorized from within the external application 78. If access is authorized from the external application 78, the micro controller 66 will initiate a rotation of the servo motor 16 to turn the servo mating coupler 22 which will turn the finger operated rotational lock/unlock mechanism 56 and the door knob 52 will be unlocked. If the content of the HTTP response does not include authorization from the external application 78, the knock is not validated and the access does not proceed.

An external application 78 could be any application capable of responding to HTTP requests from a client. External applications 78 would be expected to be built with robust security and user authentication features with the ability to allow users of the external application 78 to manage access rules and user roles related to users' devices. The rules regarding how, when, and if validation should occur would be managed within the external application 78. An external application 78 could allow users to manage access for multiple users and multiple devices.

The network connectivity indicator light 38 indicates the status of the network connection when the knock validation mode switch 42 is set to "external". If a useable network connection is detected, the network connectivity indicator light 38 illuminates. If no connection is present the network connectivity indicator light 38 will not illuminate. If there are errors with the network connection, the network connectivity indicator light 38 may blink a pattern to indicate the type of error.

The audio mode switch 44 controls whether the system generates audio tones to communicate failed or successful access attempts. If the audio mode switch 44 is on, audio tones will be generated to provide audio feedback for successful knock validation and failed knock validation.

The status indicator light 36 indicates different statuses of the system depending on blink patterns.

The programming switch 50 allows a user to input and store a new knock pattern into the internal memory 68. When the programming switch 50 is switched on, the programming indicator light 34 will illuminate. The user may then knock a pattern of knocks. The user's knock pattern will be interpreted by the piezo knock detector 30 and transferred to the micro controller 66 via the piezo knock detector wires 62. The micro controller 66 will store the new knock pattern within the internal memory 68 as the user knocks on the door 60 with their hand as long as the programming switch 50 remains in the on position. When the programming switch 50 is released, the new knock pattern is stored to internal memory 68 and the programming indicator light 34 is turned off.

Figure 4:
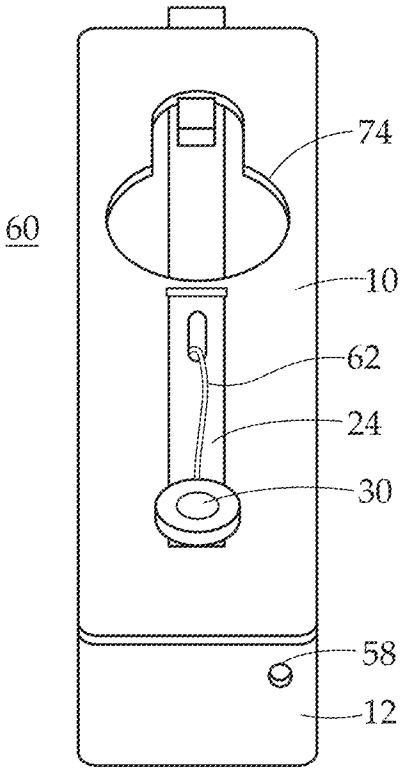
FIG. 4 is a bottom view of the invention.

FIG. 4 depicts a USB port 58 mounted within the bottom surface of the electronics container 12 to allow for software updates via an external computer.

Figure 6:
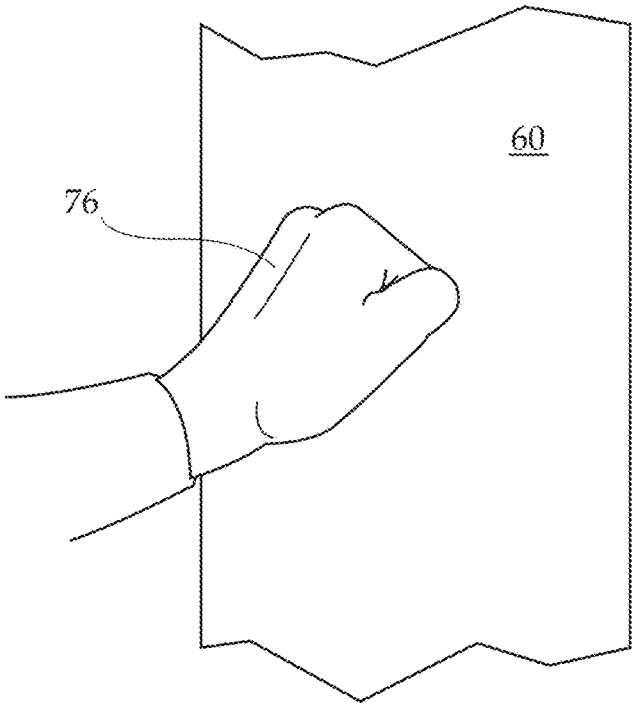
FIG. 6 is a person knocking on a door to interact with the invention.

FIG. 6 depicts a mode of operation wherein one may use a hand 76 or other means to provide pressure to a structure, such as a door 60 to provide pressure to the piezo knock detector 30.

Figure 7:
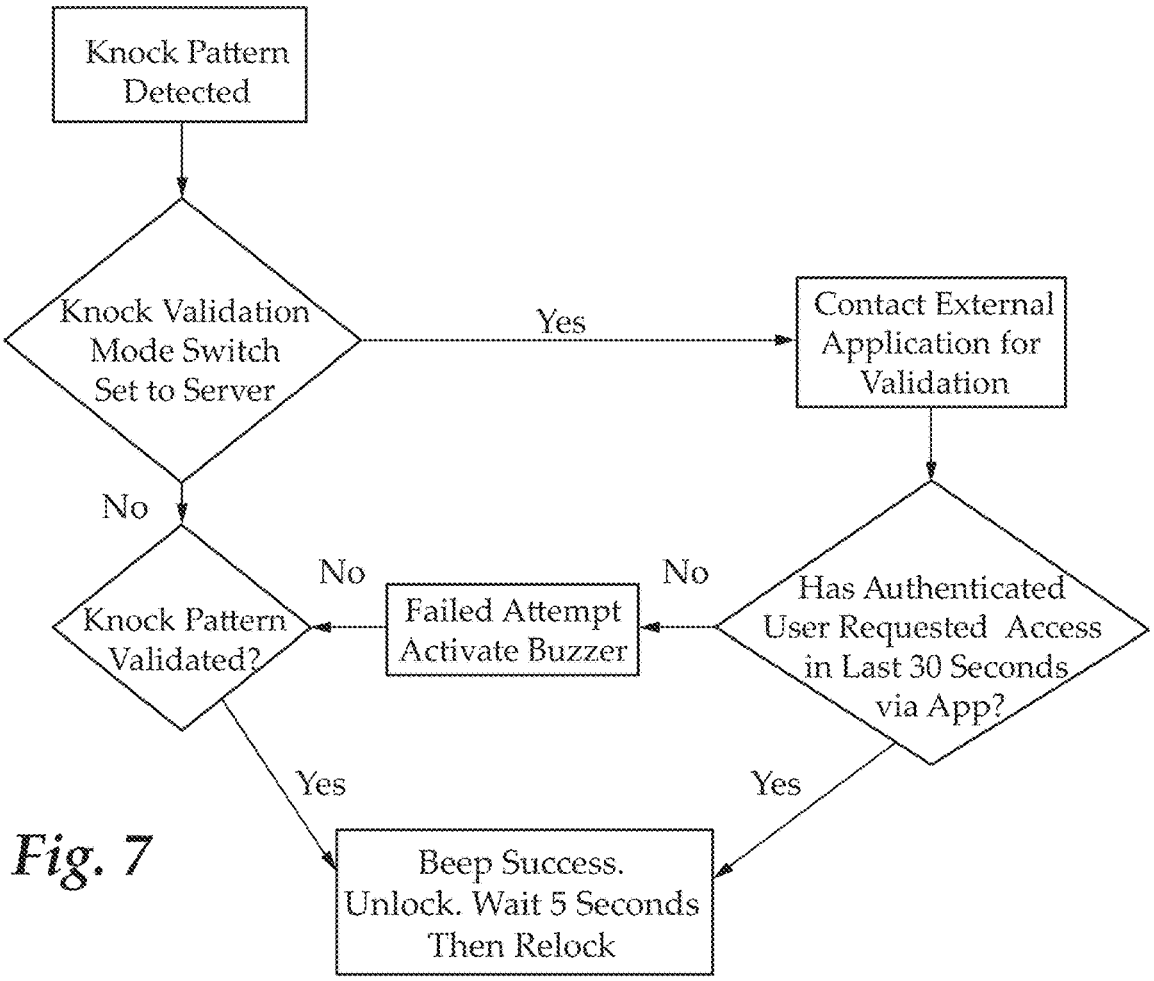
FIG. 7 is a flow chart which illustrates the two modes of granting access in response to knock patterns.
Figure 8:
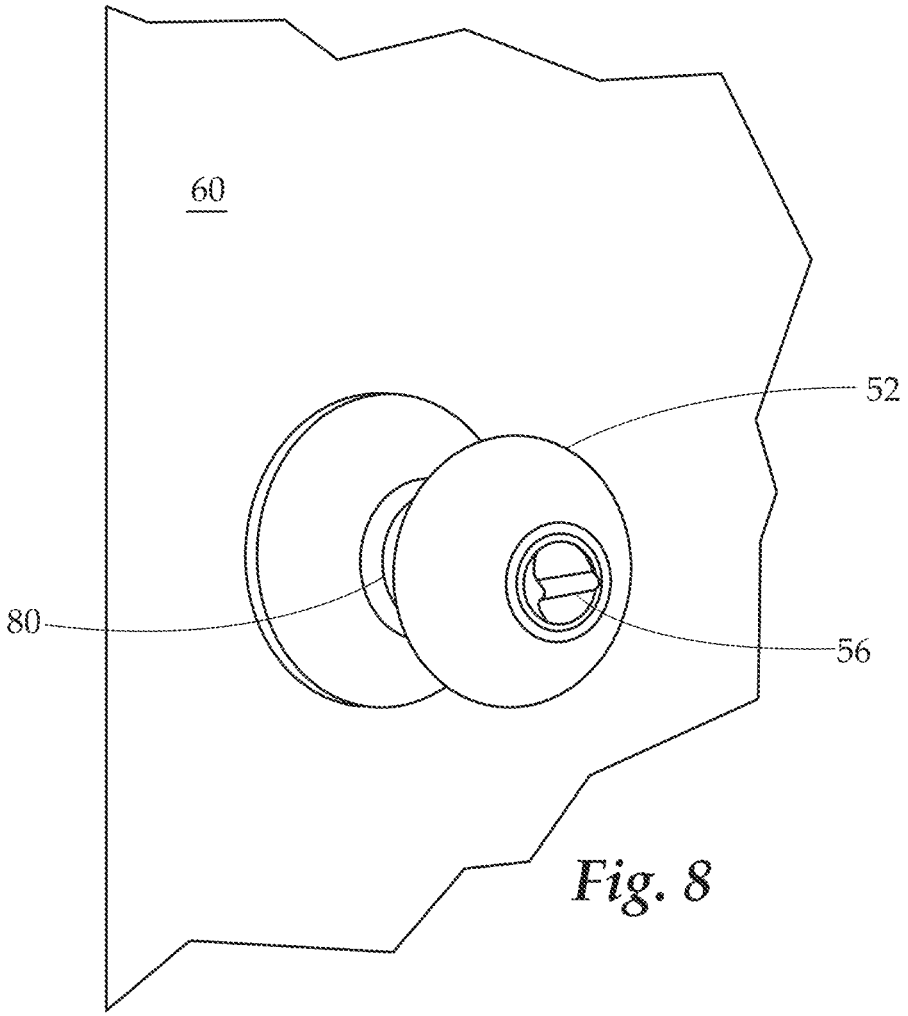
FIG. 8 is an interior view of a standard keyed entry door knob typically found on the exterior doors of homes, businesses and other structures.
Figure 9:
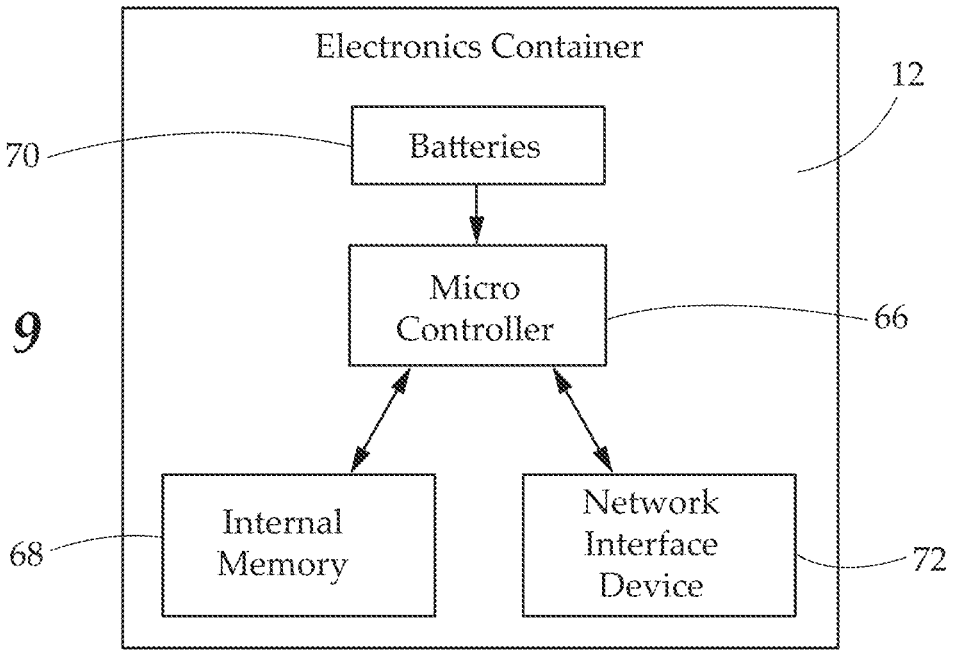
FIG. 9 is a view of the electronic components contained within the electronics container.

FIG. 7 illustrates the logical flow of behavior when a user knocks a sequential pattern of knocks on the door 60. The knock vibrations are detected individually by the piezo knock detector 30 and are converted into electrical energy and transferred via the piezo knock detector wires 62 to the micro controller 66 within the electronics container 12. The time durations between knocks are analyzed to define a knock pattern. If the time between knocks exceeds a predefined value, it is assumed that the user has completed inputting their knock pattern and the preceding sequence of knocks is considered a pattern submitted by the user. If the knock validation mode switch 42 is set to "external", a network interface device 72 is utilized to generate an HTTP request to an external application 78 for validation. Software contained within the micro controller 66 will interpret the HTTP response from the external application 78 to determine if access has been authorized within the external application. If the HTTP response indicates that the access is authorized, the knock is considered validated regardless of the knock pattern input by the user.

In this instance, the external application 78 is being relied upon to provide security. If the knock validation mode switch 42 is set to "memory" no HTTP request is generated. Instead, software within the micro controller 66 analyzes the user's knock pattern and compares the pattern against the pattern stored within internal memory 68 for validation. In "memory" mode, if the user's submitted knock pattern matches the pattern stored within internal memory, the knock is considered validated. Once a knock is validated, the micro controller 66 commands the servo motor 16 to turn the servo mating coupler 22 thereby turning the finger operated rotational lock/unlock mechanism 56 on the door knob 52.

The servo motor's 16 direction of rotation is controlled by the rotational direction switch 48 which controls whether the servo motor's 16 rotation is clockwise or counter clockwise. Different door knob 52 lock mechanisms currently on the market will require either a clockwise or counter clockwise rotational direction to unlock. Depending on the position of the audio mode switch 44, an audio tone may accompany the rotation of the servo motor 16 in order to communicate a successful validation. After a pre-defined period of time after rotating the servo motor 16 to unlock, the servo motor 16 will turn in the opposite direction to re-lock the finger operated lock/unlock mechanism 56 to restrict further access.

If a knock pattern is not validated, the servo motor 16 will not rotate and access is not granted. Depending on the position of the audio mode switch 44, an audio tone may accompany the failed validation in order to indicate a failed access attempt.

In an alternate embodiment an LCD screen and additional buttons and user interface devices may be attached to the system to allow users to configure the device.

In an alternate embodiment, other knock detection devices may be used in addition to the piezo knock detector described.

In an alternate embodiment the system would include features to record successful or failed access attempts and communicate these to users via external applications, phone calls, text messages, emails, Tweets, social media updates.

In an alternate embodiment the system would include features to restrict or grant access by time of day or depending on the state of other types of communication with external applications.

Figure 10:
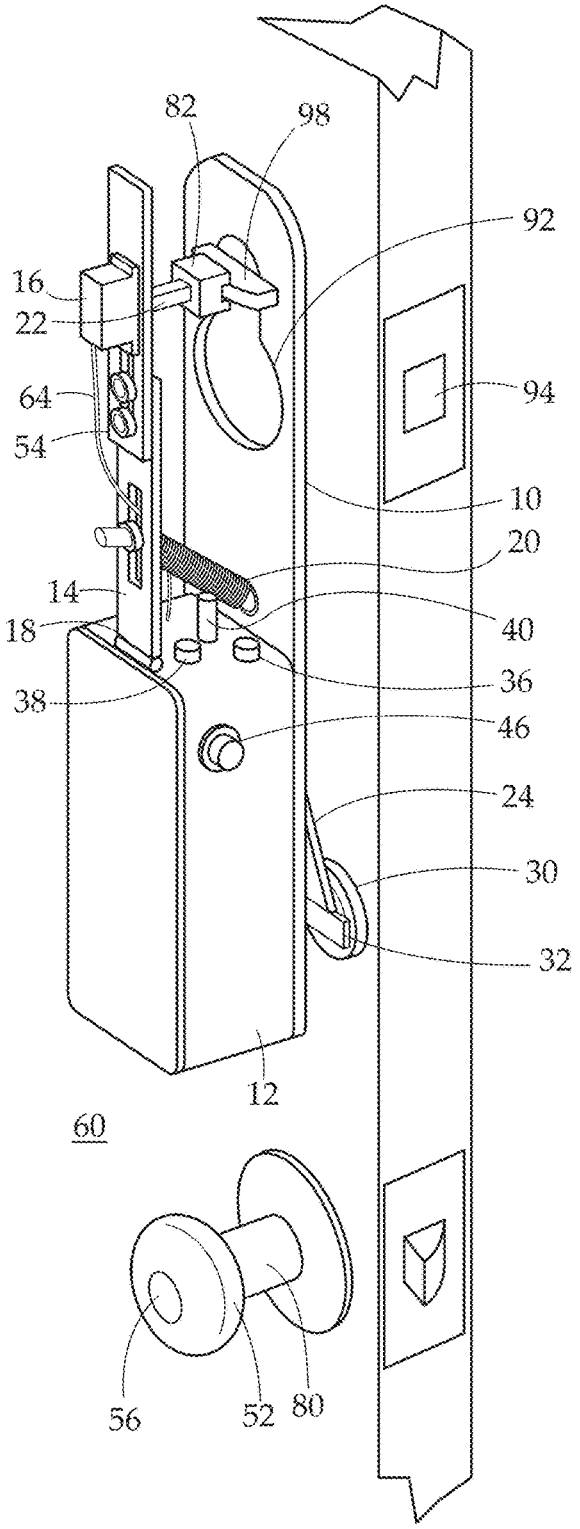
FIG. 10 is a view of an alternate embodiment of the system wherein the system is mounted on the rotational axis of the thumb turn lever on the interior of a locking deadbolt.
Figure 11:
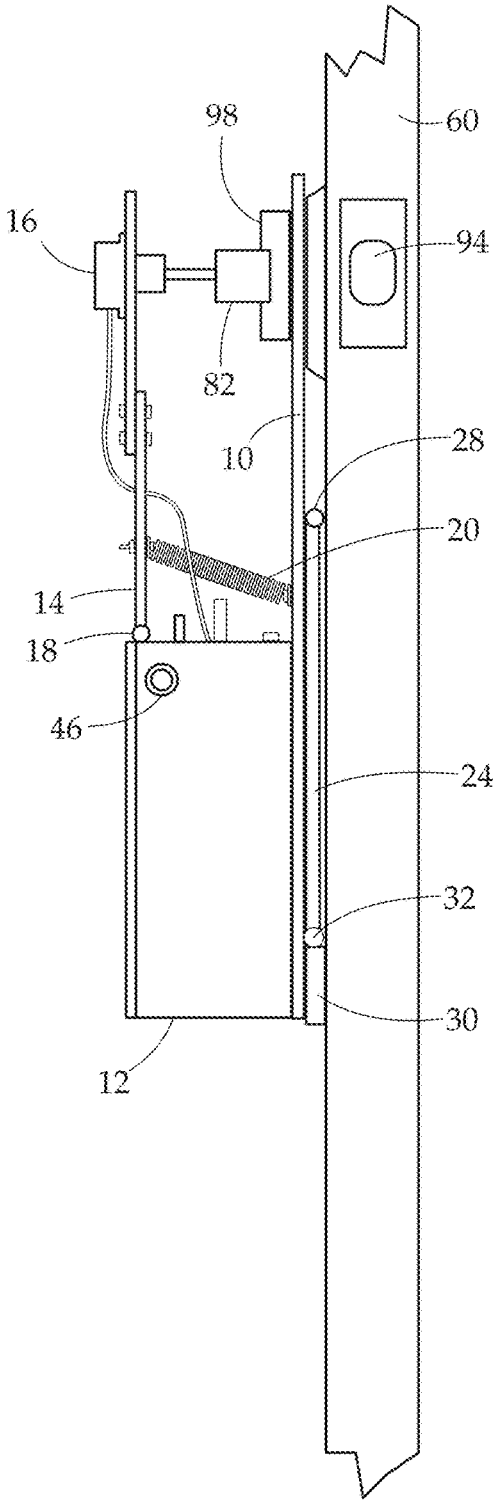
FIG. 11 is a side view of an alternate embodiment of the system wherein the system is mounted on the rotational axis of the thumbturn lever on the interior of a locking deadbolt.

An alternate embodiment of the system is illustrated in FIGS. 10 and 11. These illustrations display the system attached to a locking deadbolt. The device is attached to the deadbolt thumb turn axle 86. The deadbolt thumb turn lever 98 extends through the narrow portion of the slotted deadbolt mounting hole 92 so that the top of the narrow portion of the slotted deadbolt mounting hole 92 rests on the deadbolt thumb turn axle 86. The servo deadbolt mating coupler 82 is tensioned against the deadbolt thumb turn lever 98 via the servo tension arm 14 and servo tension arm spring 26. The servo deadbolt mating coupler 82 is shaped to conform to the shape of the deadbolt thumb turn lever 98 and to grasp the deadbolt thumb turn lever 98 snugly when tensioned against it via the servo tension arm 14 and servo tension arm spring 20. The servo deadbolt mating coupler 82 may be adjustable in size to accommodate different sized deadbolt thumb turn levers 98 and it may include a clamping mechanism to securely attach to the deadbolt thumb turn lever 98. The servo deadbolt mating coupler 82 transfers the rotational force of the servo motor 16 to rotate the deadbolt thumb turn lever 98 and unlock the deadbolt assembly to grant access.

Figure 12:
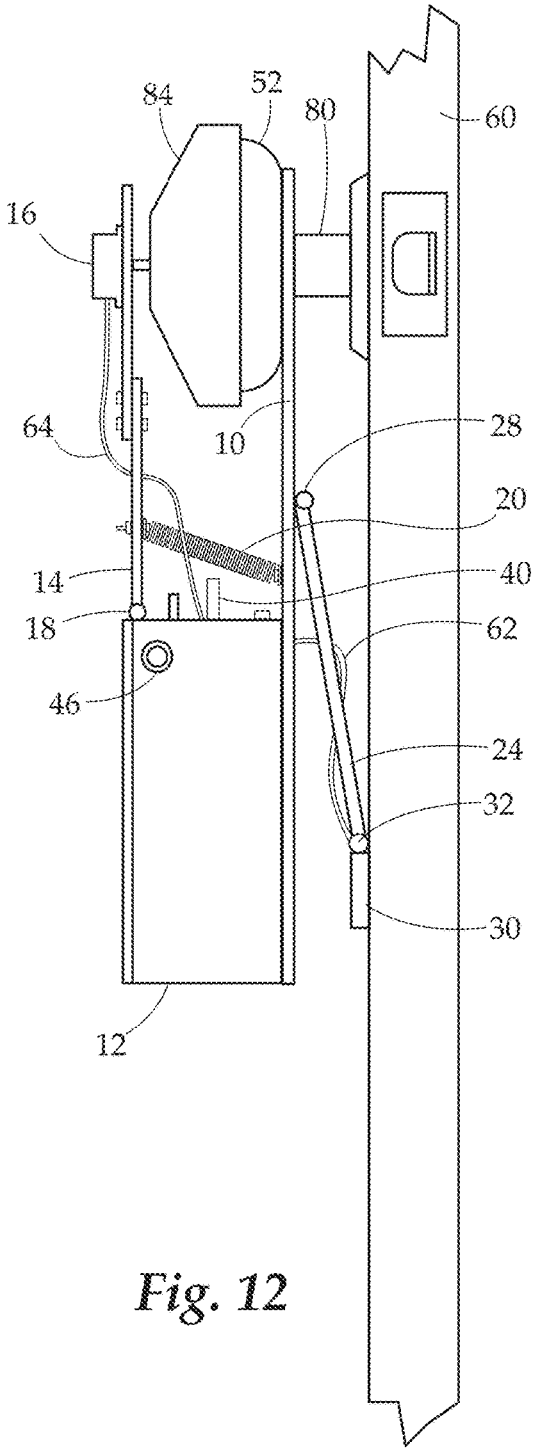
FIG. 12 is a side view of an alternate embodiment of the system wherein the system rotates the entire doorknob in order to grant access.

An alternate embodiment is illustrated in FIG. 12. This illustration shows how a servo door knob mating coupler 84 replaces the servo mating coupler 22. Instead of rotating only the finger operated rotational lock/unlock mechanism 56, the system utilizing the servo door knob mating coupler 84 will rotate the entire door knob 52 subsequent to a knock validated process. The servo door knob mating coupler 84 is tensioned against the door knob 52 via the servo tension arm 14 and servo tension arm spring 20. The surface of the servo door knob mating coupler 84 which contacts the door knob 52 is shaped to fit the contour of the door knob 52 and is made of a non slip material so that the rotational forces of the servo motor 16 are transferred to the door knob 52 to rotate the door knob 52 to grant access. An alternate embodiment of the servo door knob mating coupler 84 would include a clamping mechanism to provide an additional mechanical connection between the servo door knob mating coupler 84 and the door knob 52.

Figure 13:
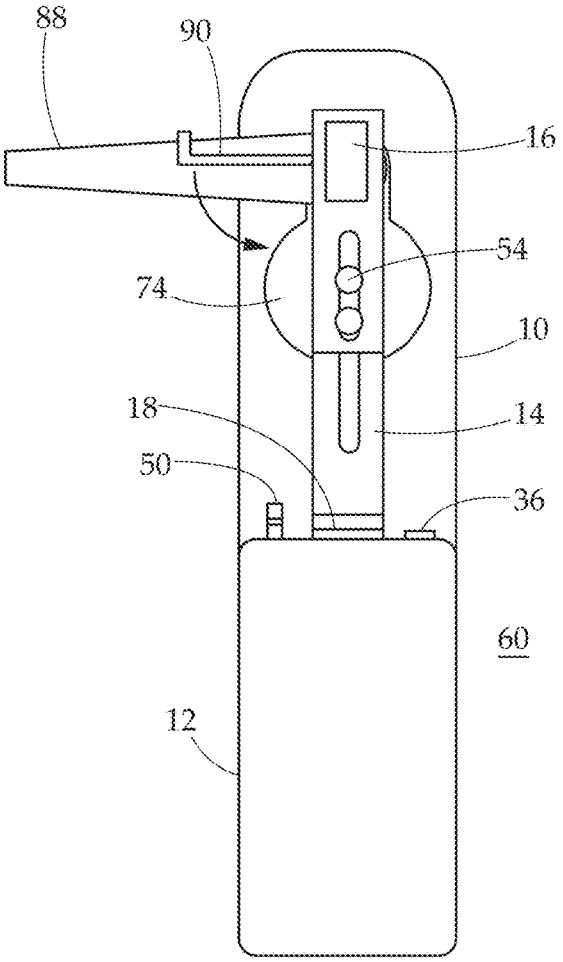
FIG. 13 is a front view of an alternative embodiment of the system wherein the system rotates the entire door lever in order to grant access.

An alternate embodiment is illustrated in FIG. 13. This illustration demonstrates how a servo door lever rotator arm 90 replaces the servo mating coupler 22. Instead of rotating only the finger operated rotational lock/unlock mechanism 56, the system utilizing the servo door level rotating arm 90 will rotate the entire door lever 96 after a knock is validated. The servo door lever rotator arm 90 is tensioned against the rotational axis of the door lever 96 via the servo tension arm 14 and servo tension arm spring 20. The rotational axis of the servo door lever rotator arm 90 is aligned with the rotational axis of the door lever 96.

The outer end of servo door lever rotator arm 90 extends at a ninety degree angle inward towards the door 60 to contact either the top or bottom surface of the door lever handle 88. When a knock is validated, rotation of the servo door lever rotator arm 90 transfers the rotational movement of the servo motor 16 to the servo door lever rotator arm 90 to rotate the door lever 96 and grant access. As in other embodiments described, the direction of rotation can be controlled by the rotational direction switch 48. Based on the desired rotation direction, the user may choose to initially mount the servo door level rotator arm 90 so that it makes contact with either the top or bottom surface of the door lever handle 88.

An alternate embodiment allows for two instances of the system to communicate with each other in order to share the lock validation features of one of the devices. This would be useful in a configuration where two instances of the system are connected simultaneously to both a door knob 52 or door lever 96 and a deadbolt assembly 94 attached to the same door 60. In such a configuration, the two systems could communicate via wired or wireless communication. In this configuration, a user would select which instance of the system would be responsible for knock validation as the "primary device" and which instance should be considered the "secondary device". The secondary device would not provide any knock validation, it would rely on the primary device to determine knock validation. The secondary device would take commands from the primary device and actuate the lock/unlock process based on commands from the primary device.

In an alternate embodiment, the system would be configured to so that the servo motors to unlock both a locking deadbolt and a door knob or door lever would be attached to a single system. This would allow a single system to unlock both a door knob or door lever and a locking deadbolt. In such a configuration, two servos may be mounted to a single servo tension arm or two separate servo tension arms may be used to provide the tension and positioning for the servo motor and the servo mating coupler, servo deadbolt mating coupler, or servo door knob mating coupler.

Figure 14:
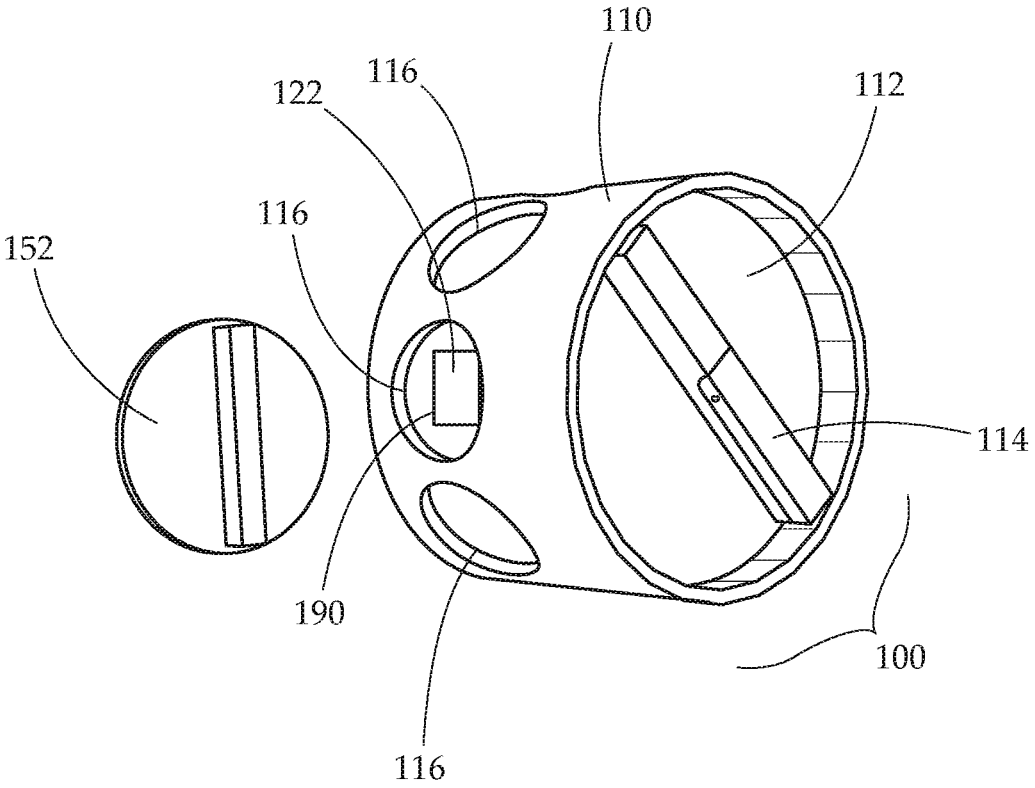
FIG. 14 is a view of an alternative embodiment of the system wherein the device is fitted to the interior lever of a deadbolt lock.

FIG. 14 illustrates one embodiment of a device 100 configured preferably for use with a deadbolt wherein the device 100 is securely fitted to an interior rotating lever of a deadbolt lock 152. In one embodiment, the device 100 contains an outer housing 110 and an inner housing 112. In this embodiment, the outer housing 110 is substantially cylindrical, but other shapes which correspond to doorknobs, door levers and deadbolts, or any other similar alternative door handles/locking mechanisms may be imagined. The outer housing 110 contains and houses a set of internal components of the deadbolt lock mechanism 100 and contains a plurality of holes 116 which are large enough to allow a user to access the internal components of the device 100 with their fingers. The plurality of holes 116 allow access to a deadbolt lever engagement assembly 122. The deadbolt lever engagement assembly 122 is secured to the rotating lever of the deadbolt 152 on the interior of a door (not shown). The outer housing 110 further comprises at least two ends, a door contact end 170A (see FIG. 15) which is placed in contact with the door utilizing the device 100 is used and a control end 170B which is fitted over an outer surface of a door knob. A non-slip rubber coating may be applied to the door contact end 170A to keep the device 100 held against the door. In other embodiments, other non-slip materials or magnets could be substituted for the non-slip rubber, or used in combination with the non-slip rubber, to keep the device 100 securely in place on the door. The inner housing 112 fits inside the outer housing 110. The inner housing 112 is able to slide within the outer housing 110. The inner housing 112 contains the batteries, electronics, and motor (see FIG. 19) to rotate a lever rotation axle 128 (see FIG. 15) and the deadbolt level engagement assembly 122. The lever rotation axle 128 is configured to pass through the inner housing 112 to be in communication with a mounting latch 114.

Figure 15:
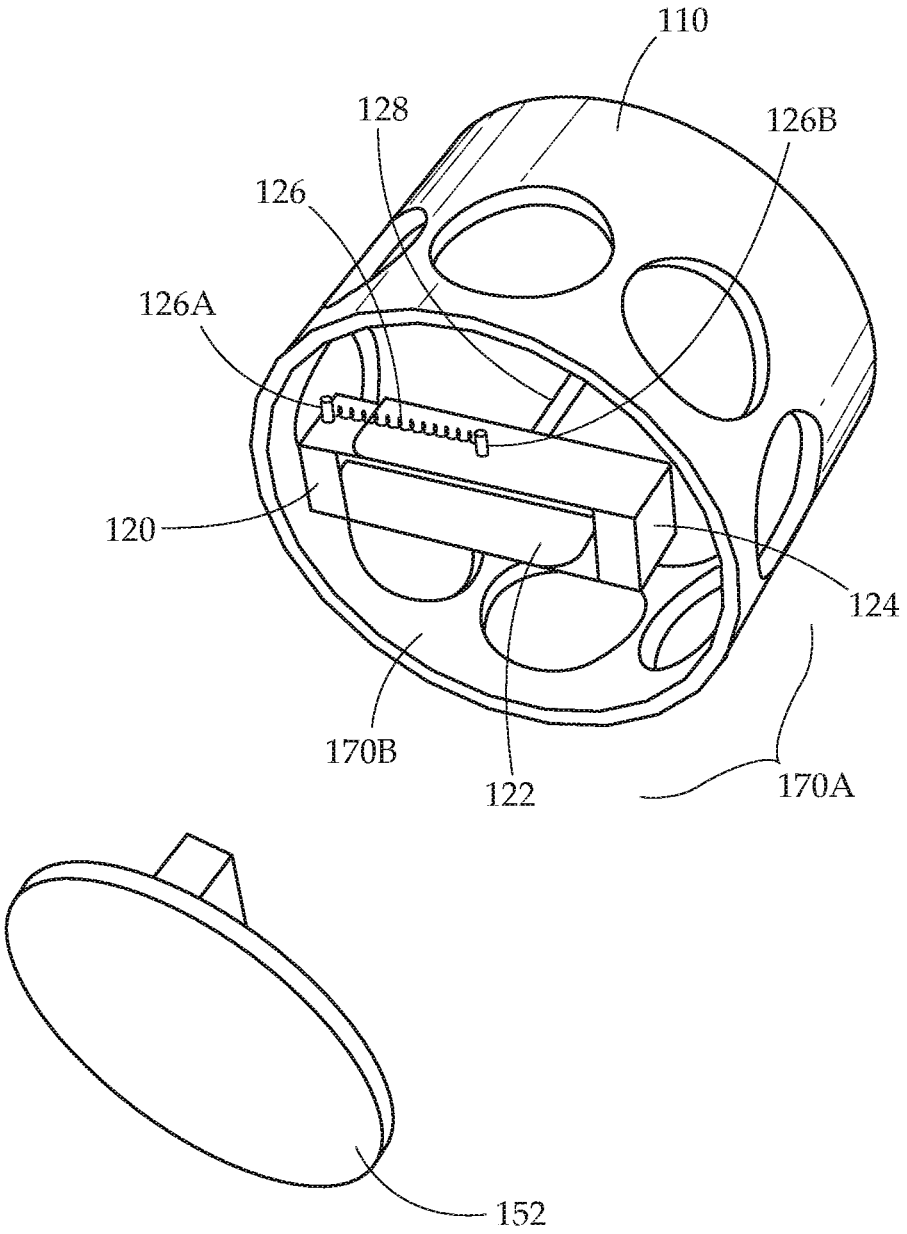
FIG. 15 is a view of one embodiment the fitted device looking from the perspective of the deadbolt.

FIG. 15 illustrates one embodiment of a front view of the fitted deadbolt device 100. Enclosed within the outer housing 110 is the lever rotation axle 128 and deadbolt lever engagement assembly 122. The lever rotation axle 128 is comprised of an outer tube 180 and an inner rod 182. The inner rod 182 extends through the outer tube 180. The inner rod 182 connects to the mounting latch 114 such that when the mounting latch 114 is engaged, a clamping force is applied to a pivot point 190 where the lever rotation axle 128 engages with both sides of the deadbolt lever engagement assembly 122. The clamping effect allows the pivot point 190 of the deadbolt lever engagement assembly 122 to be positioned to match the pivot point of the deadbolt lever on the door. Once the clamping force is applied, the lever rotation axle 128 is secured at the pivot point. Some deadbolt levers have an offset pivot point where the length of the lever is not symmetrical on either side of the axis of rotation. Adjusting and securing the lever rotation axle at the matching pivot point allows the device to be used on both deadbolt levers with either symmetrical or asymmetrical lever lengths. The deadbolt lever engagement assembly 122 is comprised of a first engagement component 120 and a second engagement component 124, wherein the first engagement component 120 can be slid into the second engagement component 124 such that the overall length and positioning of the deadbolt lever engagement assembly 122 may be adjusted. The first and second engagement components 120, 124 are pulled together by at least one spring 126, with one end of the spring 126A being positioned on the first engagement component 120 while the opposite end of the spring 126B is positioned on the second engagement component 124.

Figure 16:
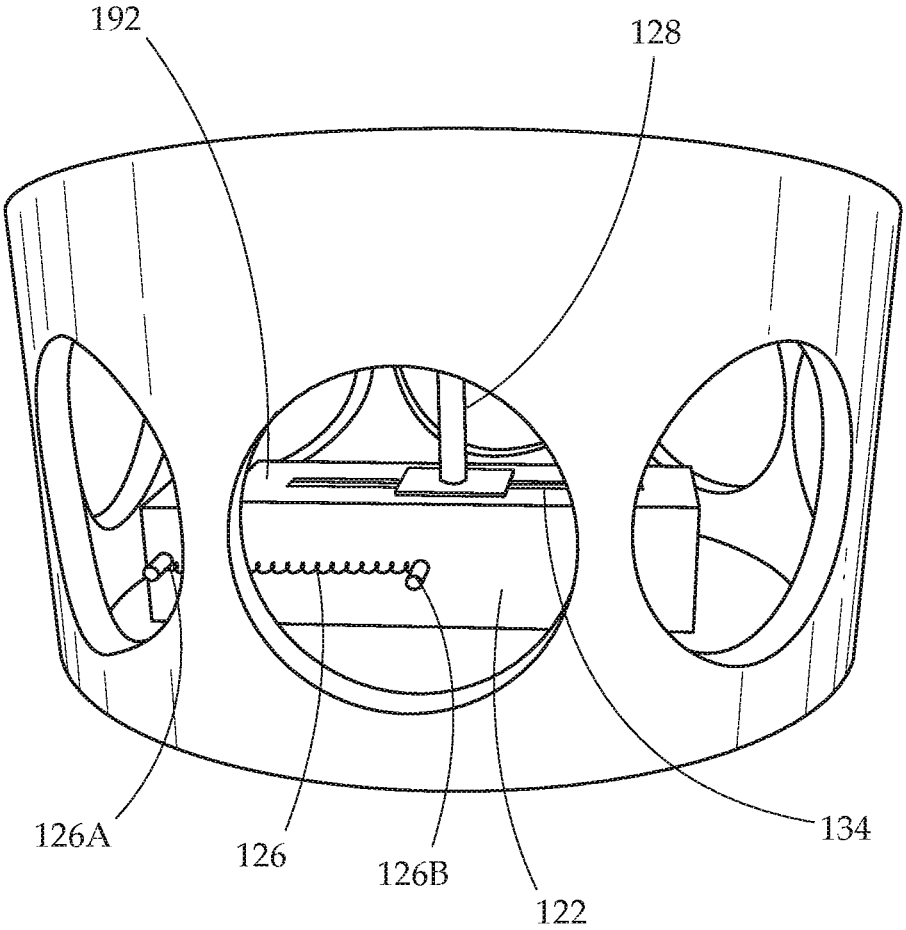
FIG. 16 is a side view of one embodiment of the fitted deadbolt device in which the deadbolt lever engagement assembly can be seen through the holes of the outer housing.

FIG. 16 illustrates a view of the deadbolt lever engagement assembly 122 inside the outer hosing 110. The deadbolt lever engagement assembly 122 may be accessed and adjusted by a user inserting his or her fingers through one or more of the plurality of holes 116 of the outer housing 110. On an upper side 192 of the first engagement component and the second engagement component each contain a channel 130, 134. The channel 130 of the first engagement component 120 lines up with the channel 134 of the second engagement component 124, such that the channels 130, 134 run through the combined deadbolt lever engagement assembly 122. The channels 130, 134 allow the deadbolt lever engagement assembly 122 to be positioned on the lever rotation axle 128 such that the lever rotation axle 128 corresponds to the pivot point of the deadbolt rotation. In operation, a user secures the first and second engagement components 120, 124 around the deadbolt lever. Next, the user positions the deadbolt lever engagement assembly relative to the lever rotation axle such that the pivot point of the device corresponds to the pivot point of deadbolt lever. Once the lever engagement assembly is secured around the deadbolt lever and positioned such that the pivot point of the device corresponds to the pivot point of the deadbolt lever, the mounting latch is engaged. Once engaged, the latching mechanism of the mounting latch clamps the lever rotation axle in place and prevents the first and second engagement components of the deadbolt lever engagement assembly from separating or becoming unsecured from the deadbolt lever.

Figure 17:
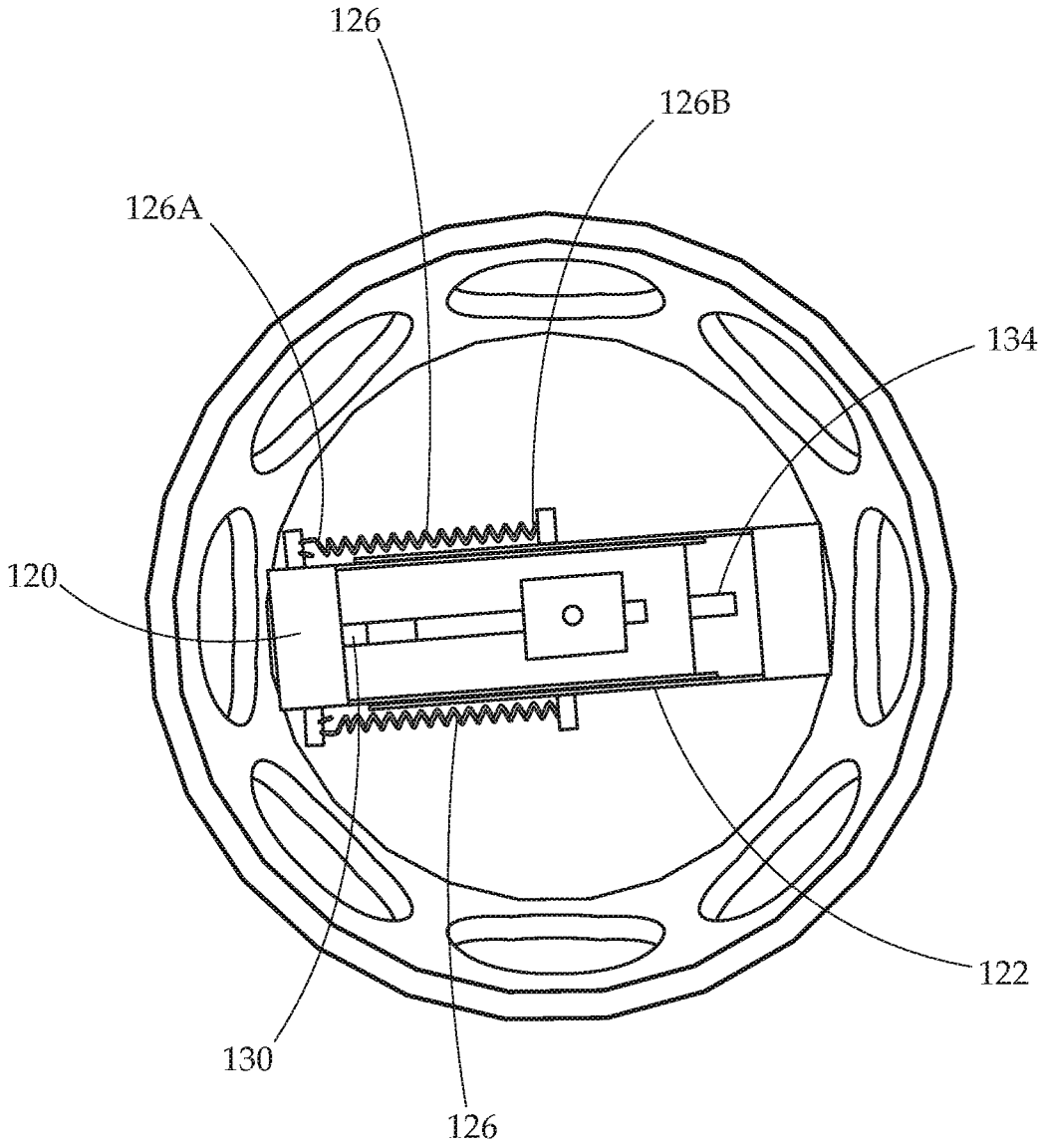
FIG. 17 is a bottom view of one embodiment of the fitted deadbolt device in which the deadbolt lever engagement assembly can be seen.

FIG. 17 illustrates a bottom or door end view of the fitted deadbolt device. The first 120 and second 124 engagement component of the deadbolt lever engagement assembly 122 are shown with at least one spring 126 on each lateral side of the first and second engagement component 120, 124. The spring 126 pull the first engagement component 120 into the second engagement 124 component to define the length of the deadbolt lever engagement assembly 122. The spring 126 may be extended or compressed to accommodate deadbolt levers of various lengths. The lever rotation axle 128 extends through the channels 130, 134 of the first and second engagement components 120, 124 of the deadbolt lever engagement assembly 122. The deadbolt lever engagement assembly 122 is positioned around the lever rotation axle 128 such that the pivot point of the device 100 corresponds to the pivot point of the deadbolt lever. Once the mounting latch 114 is engaged, the first and second engagement components 120, 124 of the deadbolt lever engagement assembly 122 are clamped together securely around the deadbolt lever. This clamping force fixes the lever rotation axle 128 in place in the channels 130, 134 of the first and second engagement component 120, 124 of the deadbolt lever engagement assembly 122.

Figure 18:
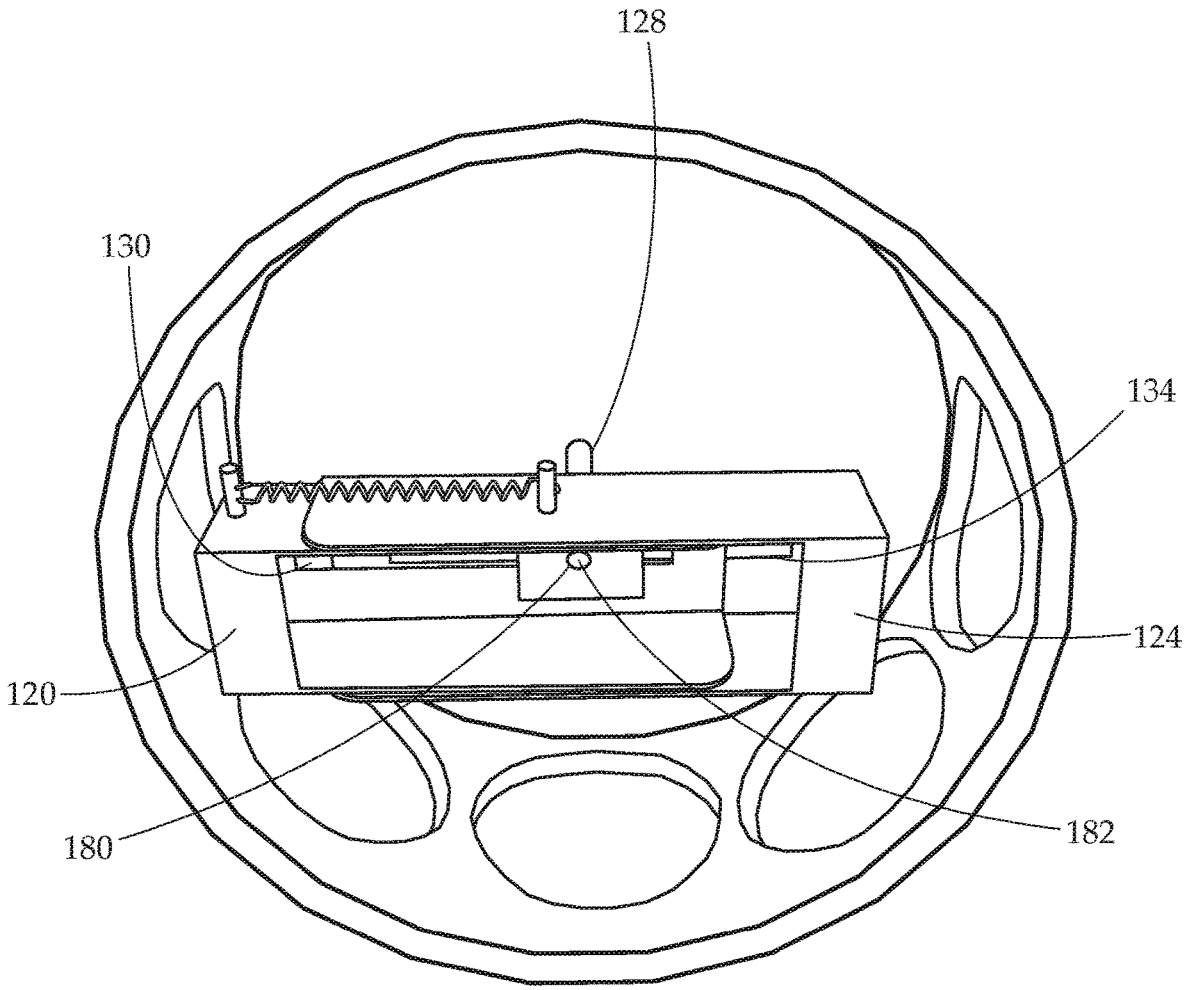
FIG. 18 is a skewed bottom view of one embodiment of the fitted deadbolt device.

FIG. 18 illustrates a bottom perspective view of one embodiment of the doorknob fitted device 100 wherein the first and second lever engagement components 120, 124 are visible as well as the lever rotation axle 128.

Figure 19:
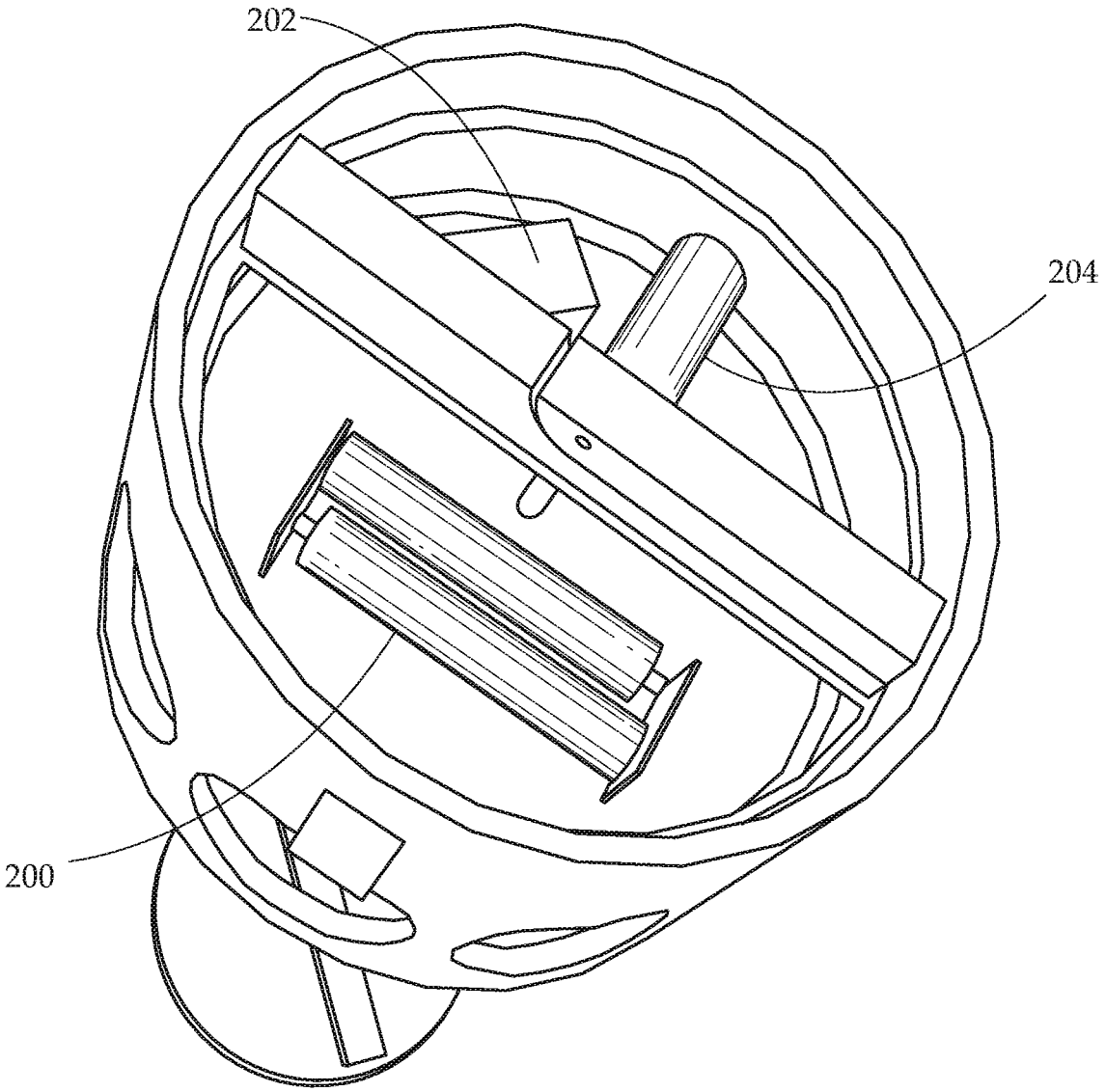
FIG. 19 is a bottom cut out view of an embodiment of the inner housing.

FIG. 19 illustrates a cut out perspective view of an embodiment of the inner housing 112. Enclosed in the inner housing 112 are a set of batteries 200, a set of electronic components 202, and a motor 204 to rotate the lever rotation axle 128 which rotates the deadbolt. In this embodiment, the set of electronic components 202 include a position sensor for the lever rotation axle 128, vibration sensors, radio antennas to communicate via wireless standards such as Bluetooth and WiFi. The mounting latch 114 is positioned on the top of the inner housing 112. The lever rotation axle 128 passes through the inner housing 112 to connect to the mounting latch 114.

Figure 20:
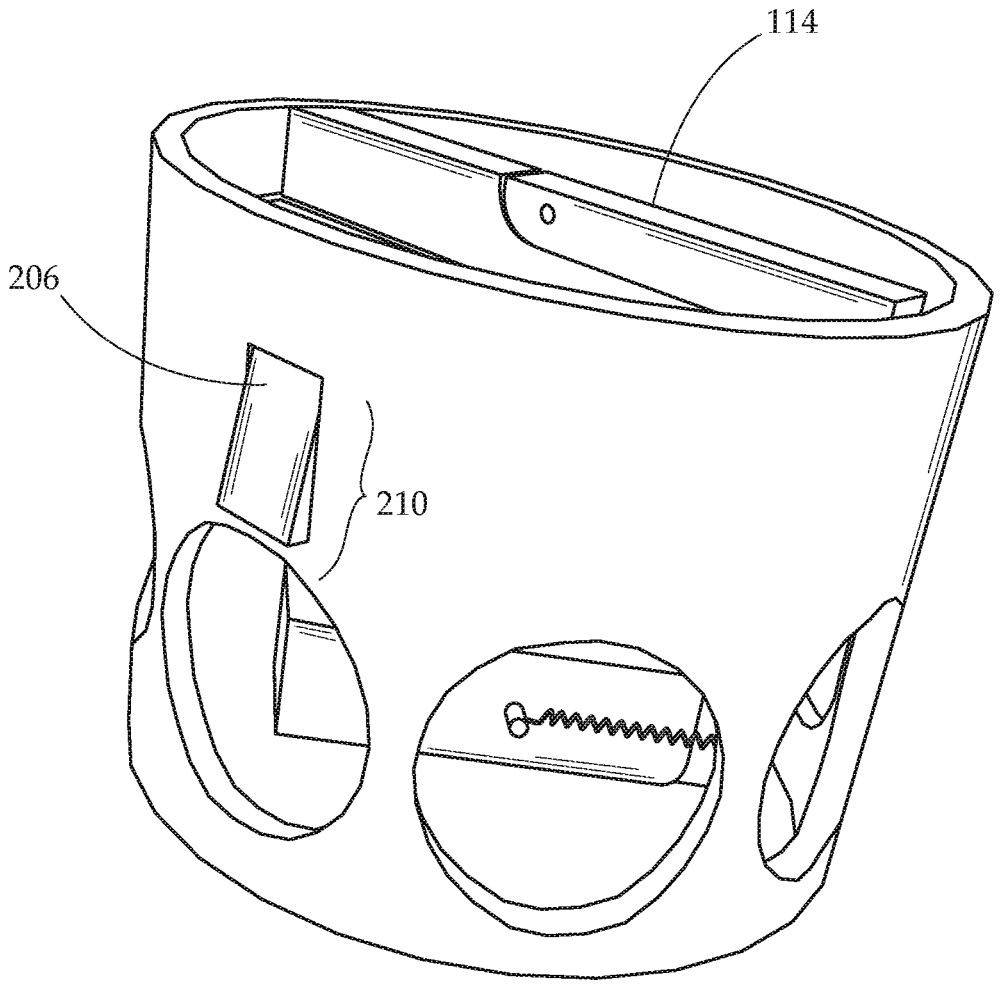
FIG. 20 is a view of the mounting latch and one of two ratcheting mechanisms.

FIG. 20 illustrates the mounting latch 114 and one of two ratcheting mechanisms 206. The ratcheting mechanism 206 exists within either side of the outer housing 110. The ratcheting mechanism 206 consists of a spring loaded hinged plane 210 on the outer housing 110. One end of the hinged plane 210 connects with a ridged surface of teeth lined up longitudinally on the outer surface of the inner housing 112 to create a ratcheting effect between this surface of teeth on the inner housing 112 and the hinged plane 210 on the outer housing 110. The ratcheting mechanisms 206 allow the user to pull the inner housing 112 so that it slides within the outer housing 110 away from the surface of the door while the outer housing 110 maintains pressed against the door. As the user pulls the inner housing 112 away from the door and slides the inner housing 112 within the outer housing 100, the ratcheting mechanisms 206 locks the position of the inner housing 112 relative to the outer housing 100. The tension created between the deadbolt on the door, deadbolt lever engagement assembly 122, lever rotation axle 128, inner housing 112, and the outer housing 110, holds the device 100 tightly against the door's surface. To remove this tension, the user pushes on the side of the hinged plane 210 opposite the side which interacts with the ridged teeth surface of the inner housing 112. Removing the tension allows the inner housing 112 to slide back towards the door to facilitate removal of the device 100 from the door. The mounting latch 114 comprises a clamping mechanism which clamps the first and second engagement components 120, 124 of the deadbolt lever engagement assembly 122 such that the deadbolt lever engagement assembly 122 remains fixed to the deadbolt lever.

Figure 21A:
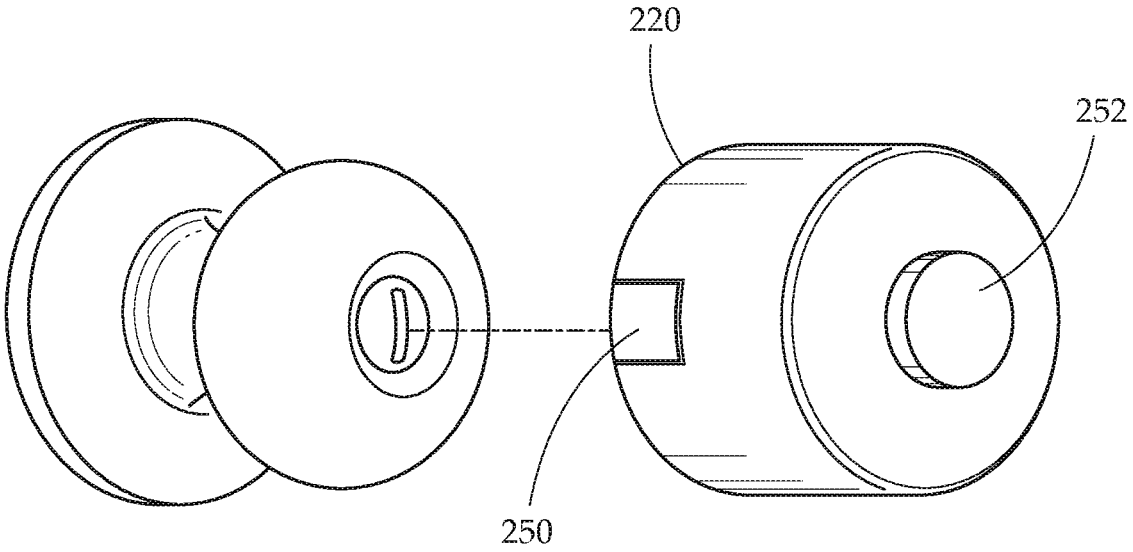
FIGS. 21A-21B illustrate a side view and a bottom view of one embodiment of a fitted door knob device.
Figure 21B:
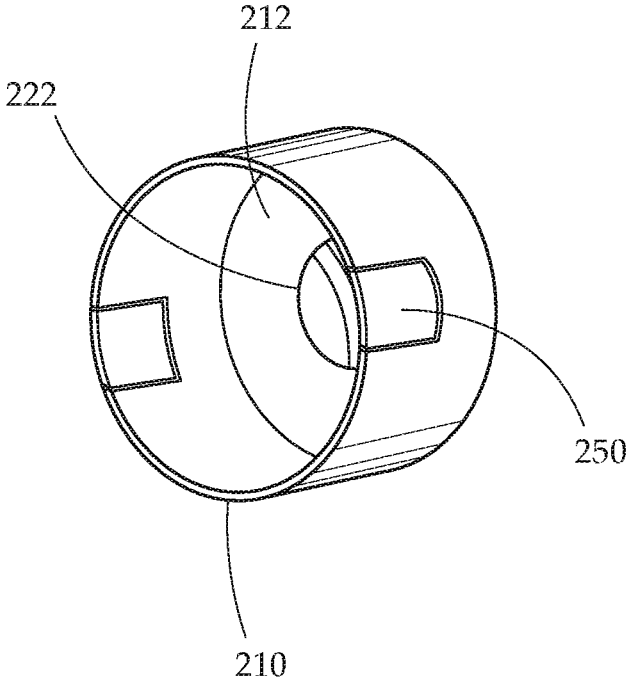

FIGS. 21A and 21B illustrate a side view and a bottom view of one embodiment of a fitted door knob device 100 which is secure on the doorknob without being in contact with the door. The housing 220 comprises the batteries, electronics, and a motor which is capable of turning the lock via a mating coupler 222 which contacts the rotating lock mechanism of a locking door knob. A rotational actuator 224 is located on the top surface of the outer housing. The rotational actuator 224 may be actuated by the motor to unlock the door and may be actuated manually to lock or unlock the door.

Figure 22:
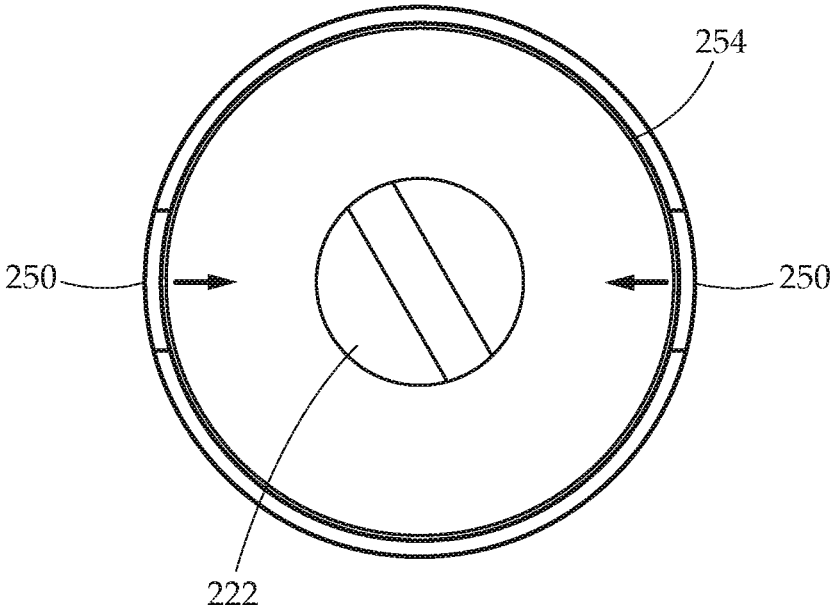
FIG. 22 is an internal view of one embodiment of a fitted door knob device with hinged tabs.

FIG. 22 illustrates an internal view of the fitted door knob device of FIG. 21. A set of magnets 254 are located on the inner surface of the outer housing to help hold the device in place against the door knob. Additionally, at least one hinged tab 250 with at least one spring are located on the outer housing to assist in holding the device in place on the door knob.

The device comprises at least two hinged tabs which can be pressed inward to secure the device onto a doorknob. Additionally, magnets are located on the inner surface of the outer housing to secure the device to the door knob. A mating coupler exists in the center of the housing. The mating coupler connects the rotating lock mechanism of a door knob with a motor contained in the housing to allow the motor to rotate the locking mechanism of the door knob.

Figure 23:
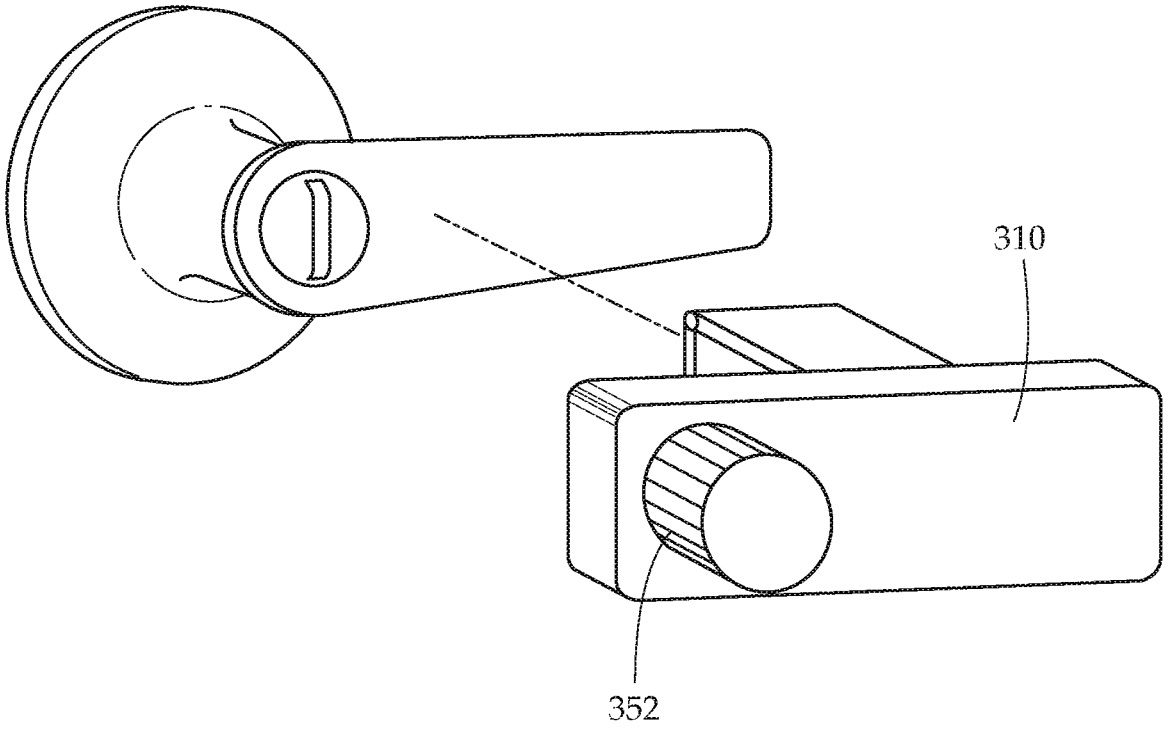
FIG. 23 illustrates one embodiment of a locking/unlocking device designed to be fitted over a door lever.

FIG. 23 illustrates an embodiment of a locking and unlocking system which fits around a door lever. The fitted door lever device comprises a housing 310 which is designed to fit around the door lever. The housing comprises a turning knob 352 which is designed to correspond with the lock button or lever on the door lever handle.

Figure 24:
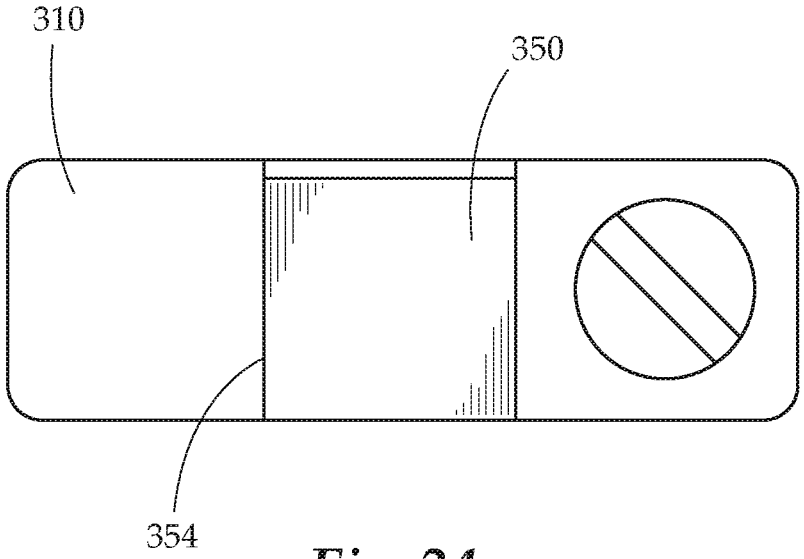
FIG. 24 illustrates a bottom view of one embodiment of a locking/unlocking device designed to be fitted over a door lever.

FIG. 24 illustrates a bottom view of one embodiment of the fitted door lever device. The bottom of the housing 354 is magnetic to hold the device onto the door lever. Additionally, a hinged tab with a spring 350 is also provided to secure the device on the door knob.

Figure 25:
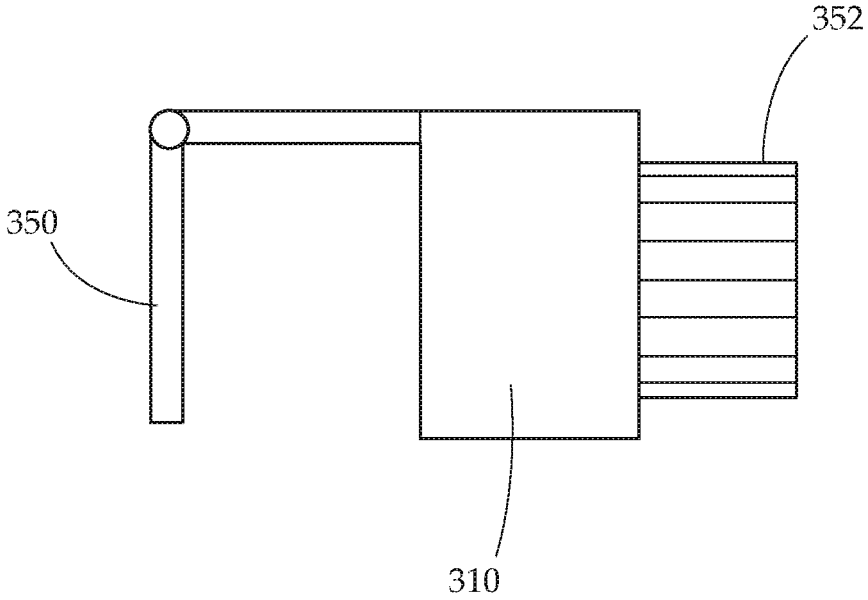
FIG. 25 illustrates a side view of one embodiment of a locking/unlocking device designed to be fitted over a door lever.

FIG. 25 illustrates the side view of the fitted door lever device, the device comprising a housing 310, a turning knob 352, and a hinged tab 350 with a lockable spring. The turning knob can be actuated by a motor to unlock the door, additionally, the knob can be actuated manually to lock the door from the interior of the home, building, or other structure.

In an alternative embodiment the system may be attached to a door knob or door lever in a different manner from what has been described. Additionally, the system may be shaped to accommodate door knobs, levers, door lock, deadbolts, or other types of door handles used for the purposes of opening doors which are not explicitly disclosed.

In conclusion, herein is presented a remote control locking and unlocking system. The invention is illustrated by example in the flow diagrams and figures, and throughout the written description. It should be understood that numerous variations are possible, while adhering to the inventive concept. Such variations are contemplated as being a part of the present invention.

What is claimed is:

1. A device configured for use with deadbolt comprising:

an outer housing wherein the outer housing comprises a plurality of holes to enable access to the inside of the device by a user;

an inner housing enclosed within the outer housing, wherein the inner housing comprises:

at least one power source;

a motor; and at least one electronic component, wherein the at least one electronic component comprises:

a position sensor for the lever rotation;

at least one vibration sensor; and at least one radio antenna for communication with a wireless communication device;

a deadbolt lever engagement assembly comprising:

at least two springs comprising:

a first end; and a second end;

a first engagement component wherein the first engagement component comprises a channel; and a second engagement component wherein the second engagement component comprises a channel, the first engagement component is partially inserted into the second engagement component, the first end of each of the at least two springs is located on the first engagement component and the second end of each of the at least two springs is located on the second engagement component such that the at least two springs hold the first and second engagement component together to allow the deadbolt lever engagement assembly to securely attach to an existing deadbolt lever;

a lever rotation axle comprising:

an inner rod; and an outer tube;

wherein the lever rotation axle is inserted into the deadbolt lever engagement assembly through the channel of the first and second engagement component and attached to the mounting latch;

a mounting latch, wherein when the mounting latch is folded flush against the inner housing, the mounting latch exerts a pulling tension on the inner rod to create a clamping force between the first engagement component, the second engagement component and the end of the outer tube; and a ratcheting mechanism, wherein after connecting the deadbolt lever engagement assembly to the existing deadbolt, the ratcheting mechanism allows a user to pull the inner housing to allow the inner housing to slide within the outer housing and away from the surface of the door while the outer housing maintains pressed against the door to lock the position of the inner housing relative to the outer housing and maintain a firm pressure against the door.

2. The device of claim 1 wherein one ratcheting mechanism exists within either side of the outer housing further comprises at least one hinged tab with at least one spring, wherein one end of the hinged tab connects with a ridged surface of teeth lined up longitudinally on the outer surface of the inner housing to create a ratcheting effect between the surface of teeth on the inner housing and the hinged tab on the outer housing.

3. The device of claim 1 wherein the mounting latch comprises a clamping mechanism wherein the clamping mechanism clamps the first engagement component and the second engagement com-ponent of the deadbolt lever engagement assembly together at a fixed position corresponding to a pivot point of a deadbolt lever.

4. The device of claim 1 wherein the outer housing is in contact with the door and comprises a rubber, non-slip coating, or a combination of rubber and magnets on the inner surface of the outer housing to prevent slipping when rotational force is applied.

5. The device of claim 1, wherein the clamping force created by the mounting latch prevents the first engagement component and second engagement component from moving relative to each other thereby allowing the first engagement component and second engagement component to maintain a secure grasp of the existing deadbolt lever.

* * * * *